US005653489A

United States Patent [19]

Fandrich et al.

[11] Patent Number: 5,653,489

[45] Date of Patent: Aug. 5, 1997

[54] GRAPPLE APPARATUS AND METHOD OF OPERATION

[75] Inventors: Helmut Edward Fandrich, 2461 Sunnyside Place, Abbotsford, British Columbia, Canada, V2T 4C4; Kelly Alfred Krammer, Abbotsford, Canada

[73] Assignee: Helmut Edward Fandrich

[21] Appl. No.: 511,367

[22] Filed: Aug. 4, 1995

[51] Int. Cl.[6] ..... B66C 3/00

[52] U.S. Cl. ..... 294/110.1; 294/88; 294/112; 294/118

[58] Field of Search ..... 294/68.23, 88, 294/106–109, 110.1, 111, 112, 118, 119

[56] References Cited

U.S. PATENT DOCUMENTS

| | | | |
|---|---|---|---|
| 52,134 | 1/1866 | Buckman . | |
| 245,475 | 8/1881 | Fowler . | |
| 572,490 | 12/1896 | Lewis . | |
| 1,003,352 | 9/1911 | Gaussiran . | |
| 1,151,052 | 8/1915 | Sales . | |
| 2,381,045 | 8/1945 | Gammel | 204/110 |
| 2,815,242 | 12/1957 | Kenyon | 294/110.1 |
| 2,959,444 | 11/1960 | Callender | 294/86 |
| 3,164,406 | 1/1965 | Barry | 294/110.1 |
| 4,396,215 | 8/1983 | McCutcheon | 294/88 |
| 4,783,106 | 11/1988 | Nutter | 294/88 |
| 4,943,099 | 7/1990 | Gabriel | 294/110.1 |

FOREIGN PATENT DOCUMENTS

| | | |
|---|---|---|
| 244272A | 1/1987 | Germany . |
| 52-69149 | 7/1977 | Japan . |
| 627807 | 6/1947 | United Kingdom . |

*Primary Examiner*—Dean Kramer
*Attorney, Agent, or Firm*—Bull, Housser & Tupper

[57] ABSTRACT

The grapple comprises left and right frame members hinged together at a main hinge, and left and right arms hinged together at the main hinge and having outer portions cooperating with a supporting cable. The grapple has left and right fingers to grasp a load, each finger being hinged to a respective frame member and connected to a respective arm. The grapple also includes a latching mechanism which cooperates with the fingers and arms to partially control angular relationship between the finger and the respective arm for actuation of the grapple. The latching mechanism is remotely controllable by an operator to release the load, and then requires re-setting to enable the grapple to grasp a subsequent load. The grapple is supported by a single cable extending from the arms to a helicopter and, prior to grasping a load, is positioned on the ground to straddle the load. When the grapple is on the ground, the cable slackens, and the latching mechanism is automatically re-set, using weight of the grapple only, and thus does not require manual intervention by a ground operator for re-setting. As the grapple is raised, the arms move upwardly and the fingers move inwardly to grasp the load, and the load is held securely until released by unlocking the latching. Weight of the load assists in forcing the fingers open which occurs at a controlled rate to reduce shock load on the helicopter.

30 Claims, 6 Drawing Sheets

GRAPPLE APPARATUS AND METHOD OF OPERATION

BACKGROUND OF THE INVENTION

The invention relates to a grapple apparatus for grasping and lifting loads, and the method of operation of the apparatus, and is particularly adapted for handling bulk loads such as logs and logging debris associated with industrial forest harvesting operations.

Logging grapples have been used for many years for lifting fallen logs, and for moving the logs to a staging area for later transportation. Such grapples were designed generally to retrieve single logs and usually had a single pair of opposed curved grapple arms which were hinged for rotation towards each other to grasp the log therebetween. Such grapples were often carried on cable systems, and some required a closing cable for drawing the arms together, and sometimes a separate opening cable for releasing the arms. Nowadays, some grapples can be suspended by a cable from a helicopter, and difficulties can arise if separate cables are required to actuate the arms of the grapple for grasping and releasing the load. If a separate cable is required to actuate the grapple, an additional grapple operator is required in the helicopter or else the helicopter pilot can be overworked. Alternatively, if actuation of the grapple requires direct manual intervention on the ground, an operator is required on the ground which increases labor costs and safety of that operator. Consequently, it is desirable to eliminate the prior art cables used to actuate the grapple. As an alternative to a separate cable or cables for actuating the grapple, other actuators such as hydraulic cylinders have been used to generate forces for moving the grapple arms. These require hydraulic fluid hoses and fluid pressurizing systems which increased complexity considerably.

When releasing a load from a prior art grapple, a release latch is actuated and this often requires some considerable force to overcome friction generated by load carried by the grapple acting on the latch. In such circumstances, when the load is released, it tends to be released suddenly, causing a shock load on the grapple and supporting cable, which can be hazardous if the grapple is carried on a helicopter.

Grapples have been used for gasping other loads, for example, U.S. Pat. No. 1,151,052 (Sales) discloses a hay lifting grapple having a pair of opposed curved arms that are rotatably mounted to a frame supported by a derrick. The lower ends of the curved arms carry a pair of opposed curved forks which are latched to the arms for gasping material therebetween. A separate cable is required to unlatch the forks to release the load. U.S. Pat. No. 1,003,352 (Gaussiran) discloses a grapple for handling large loads and is provided with two sets of curved arms mounted on a common main hinge, each set having a plurality of arms which are spaced laterally apart along the hinge on one side thereof to grasp elongated loads. The arms of each set are connected together for concurrent rotation relative to each other, and the sets of arms are controlled by a rope passing around a pair of pulleys coupled to each arm. U.S. Pat. No. 572,490 (Lewis) and U.S. Pat. 52,134 (Buckman) both disclose hay forks which are suspended from a rope and are actuated by a separate control rope. Buckman has a pair of lower rake portions, each of which is hinged to a respective main arm for rotation thereabouts, and is coupled to an opposite arm by a respective rigid link so that opening of the main arms simultaneously actuates the rake portions.

To the inventor's knowledge, most grapples used in prior art cable supported logging systems are inappropriate for helicopter use due to the complexity of cable or hydraulic actuation of the grapple, and to the said shock loads generated during opening of the grapple to release the load. Other prior art grapples require an operator close by to manually operate structure on the grapple, which would be inappropriate for helicopter carried grapples used in logging operations.

SUMMARY OF THE INVENTION

The invention reduces the difficulties and disadvantages of the prior art by providing a grapple which is particularly adapted to be used by a helicopter as it only requires a single cable for supporting the grapple from the helicopter. The grapple can be actuated remotely, and can be re-set easily without manual intervention after releasing one load, and can automatically grasp a second load without direct manual intervention. The load can be released from the grapple remotely using an electrical control wire, or alternatively wireless or other remote means. In addition, the grapple actuating mechanism can be released relatively slowly when compared with prior art grapples, thus reducing shock load imposed on the cable and thus the helicopter. Because operation of the grapple is so simple, the pilot can actuate the grapple without assistance from another operator in the helicopter, or an operator on the ground which reduces labour and other operating costs, and eliminates the hazard to ground operators of grapples associated with logging operations.

A grapple apparatus according to the invention comprises left and right frame members, left and right arms, left and right fingers, and a latching mechanism. The left and right frame members have inner portions hinged together at a main hinge and the left and right arms have inner portions hinged together at the main hinge and outer portions cooperating with a supporting cable. The left and right fingers are adapted to grasp a load, and each finger is hinged by a respective finger hinge to a respective frame member and is connected to an arm. The latching mechanism cooperates with the fingers and the arms to partially control angular relationship between each finger and the respective arm for actuation of the grapple.

The latching mechanism is selectively extensible and retractable and can be a hydraulic or mechanical latch. The hydraulic latch comprises a hydraulic cylinder having a cylinder body and a piston and piston rod, the piston and rod being longitudinally reciprocable relative to the cylinder body. Fluid valves cooperate with the hydraulic cylinder to permit actuation of the cylinder in one direction with a relatively small resistance, and actuation of the cylinder in an opposite direction with a relatively large resistance, and also locking of the cylinder.

The mechanical latch comprises a body and a rod, a latching arm, an actuator and a dashpot. The body and rod are mounted for relative reciprocable movement between extended and retracted positions thereof, the rod having a rod stop. The latching arm is mounted for movement relative to the body between retracted and extended positions thereof, and cooperates with the rod stop to lock the rod in one position thereof. The actuator cooperates with the latching arm so that, in one condition of the actuator, the actuator locks the latching arm in the said one position thereof so as to lock the rod in the said one position thereof. In the opposite position of the actuator, the latching arm can assume another position to permit the rod to assume another position. The dashpot cooperates with the rod so that speed of movement of the rod relative to the body in one direction is slowed by the dashpot compared with speed of movement in the opposite direction.

A method according to the invention is for lifting and releasing a load with a grapple, the method comprises the steps of:

supporting the grapple above a load lying on the ground so that a pair of arms of the grapple extend generally upwardly, and a pair fingers of the grapple extend generally downwardly, relieving the arms of the grapple from weight of the grapple, so that weight of the arms lowers the arms, re-setting a latching mechanism associated with the arms and fingers as the arms are lowered, raising the arms so that the re-set latching mechanism is subjected to force from the grapple, causing the fingers to move inwardly to grasp the load, and releasing the latching mechanism so that force from the grapple causes relative movement between the arms and the fingers causing the fingers to at least partially open to release the load.

A detailed disclosure following related to drawings, describes a preferred embodiment of the invention and associated method, which are capable of expression in structure other than those particularly described and illustrated.

DETAILED DESCRIPTION

Figure 1:
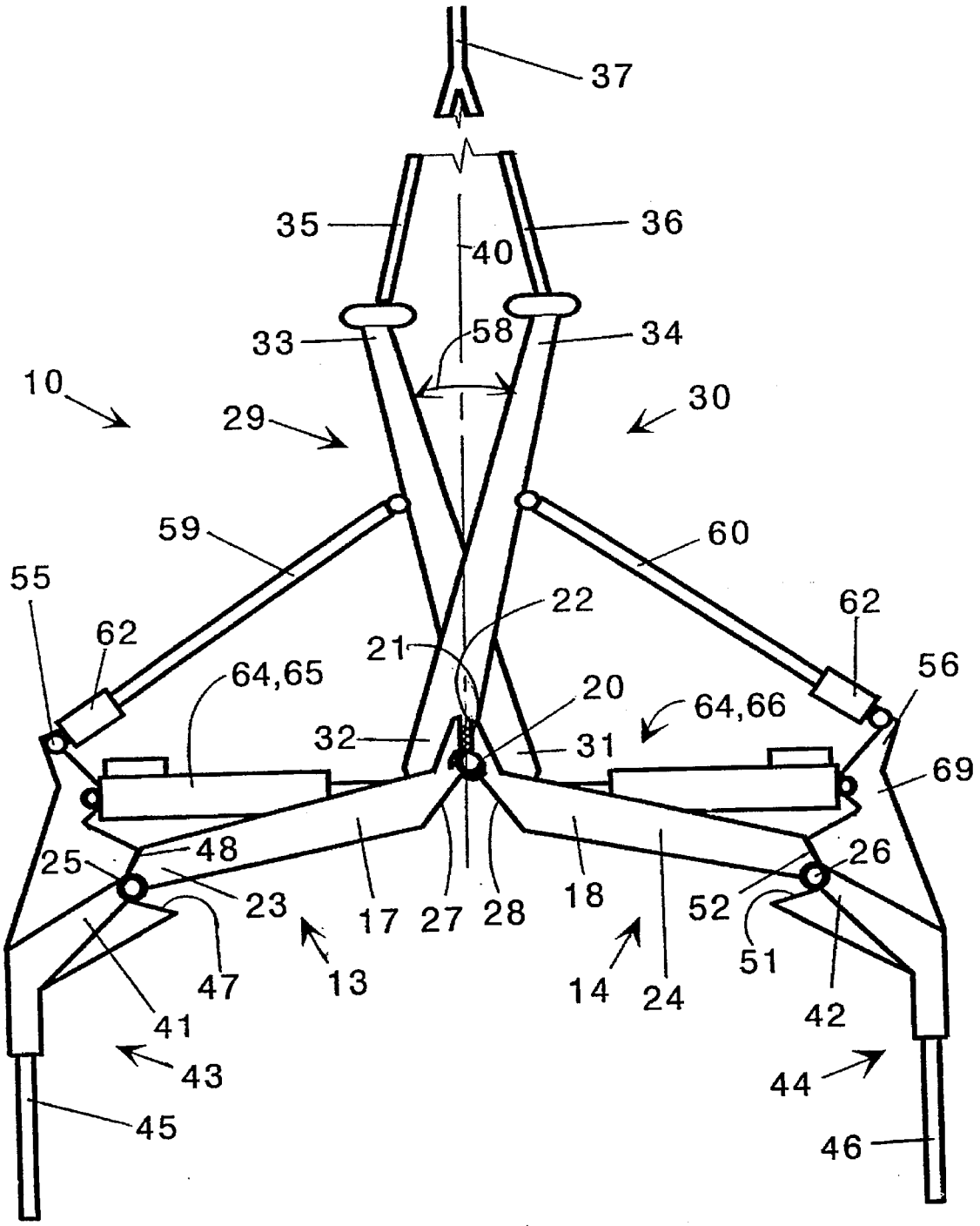
FIG. 1 is a simplified, diagrammatic rear elevation of a grapple according to the invention supported from above, the grapple being shown in an empty or unloaded ferrying condition, the front elevation being essentially the same.
Figure 2:
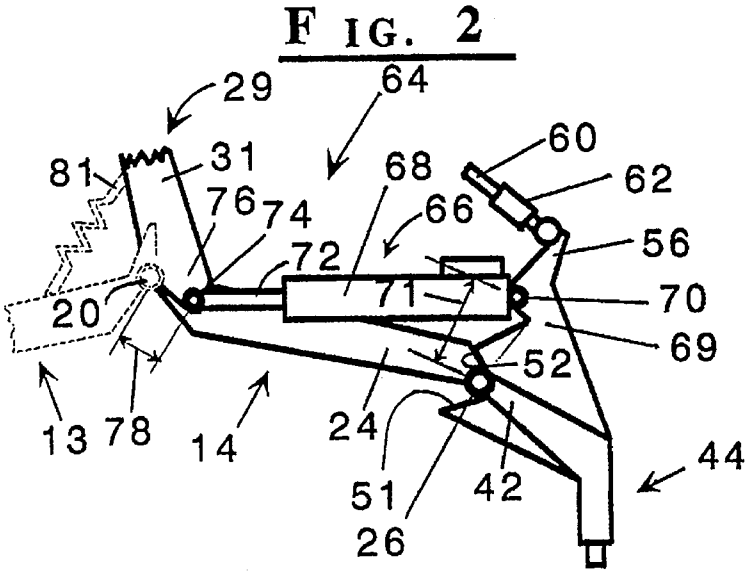
FIG. 2 is a simplified, fragmented diagram generally similar to FIG. 1 showing selected linkages on one side of the grapple.
Figure 3:
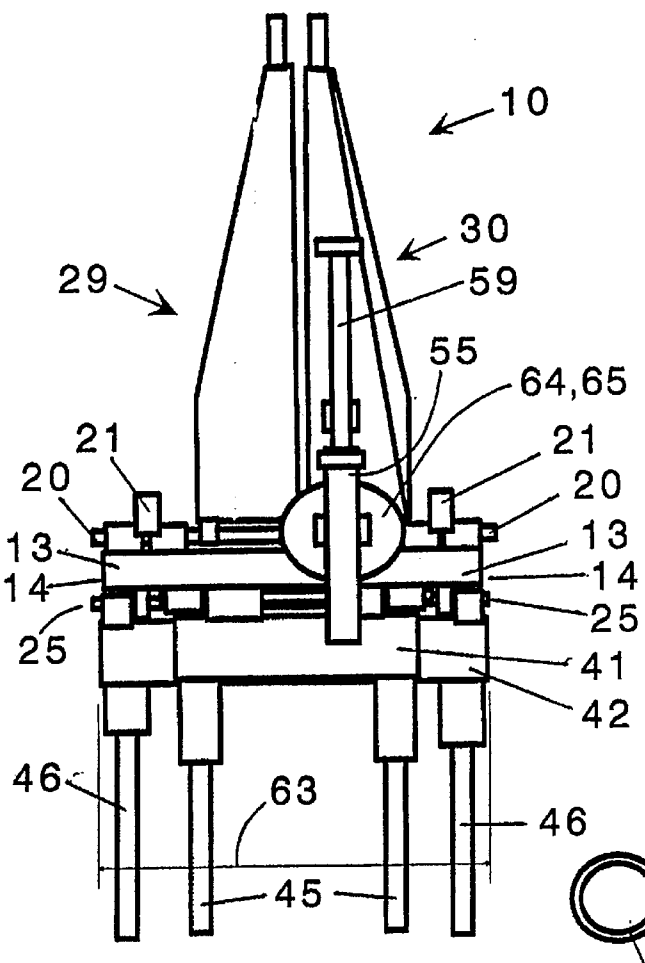
FIG. 3 is a simplified diagrammatic side elevation of the grapple in the condition of FIG. 1.

FIGS. 1 through 3

A grapple 10 according to the invention comprises left and right frame members 13 and 14 having respective inner portions 17 and 18 hinged together at a main hinge 20. The frame members 13 and 14 have outer portions 23 and 24 respectively having left and right finger hinges 25 and 26 respectively. The inner portions 17 and 18 of the frame members have left and right frame outwards stops 21 and 22 respectively which, when in contact as shown, limit outwards rotational movement of the frame members with respect to the main hinge 20. Thus, the frame members have a maximum angle between each other as shown of approximately 150 degrees. In addition, the inner portions 17 and 18 have left and right frame inwards stops 27 and 28 respectively which are adapted to contact each other to limit inwards rotational movement of the frame members with respect to the main hinge 20, which occurs when the grapple is actuated to grasp a load, as will be described with reference to FIGS. 6 and 7.

The grapple apparatus further comprises left and right arms 29 and 30 having inner portions 31 and 32 respectively hinged together at the main hinge 20, and outer portions 33 and 34 cooperating with cable portions 35 and 36 respectively. The arms 29 and 30 are shown supported in a maximum raised position which occurs when the grapple is unloaded and supported by the cable portions 35 and 36 which are a portion of a bifurcated cable 37 suspended typically from a helicopter. Thus, the grapple can be supported by a single cable from the helicopter which divides and each cable portion connects directly to a respective arm of the grapple. The arms are disposed symmetrically on opposite sides of a vertical longitudinal plane of symmetry 40 of the grapple. It is noted that the arms 29 and 30 cross the plane 40 and thus the inner portions 31 and 32 are on an opposite side of the plane 40 from the outer portions 33 and 34.

Figure 6:
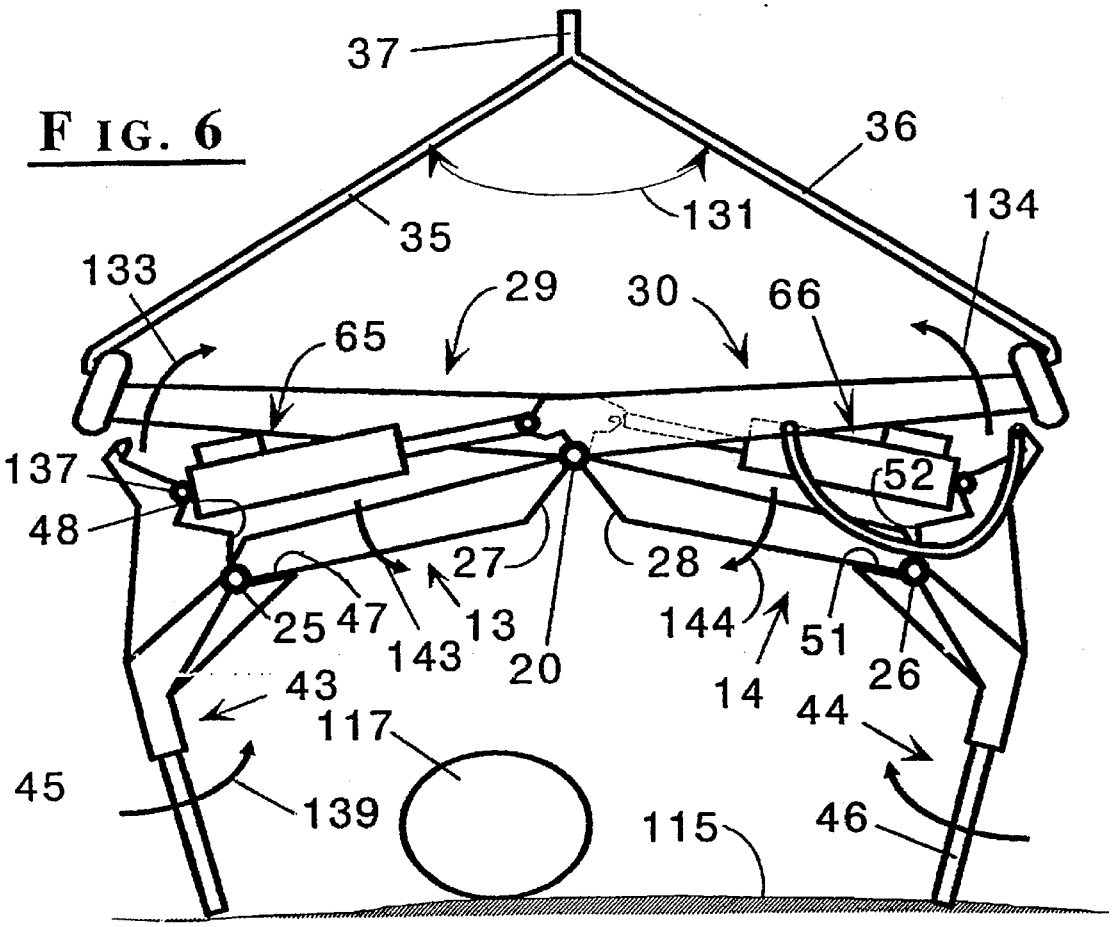
FIG. 6 is a simplified diagrammatic rear elevation of the grapple with the arms starting to rise, and the fingers starting to move inwardly towards load.
Figure 8:
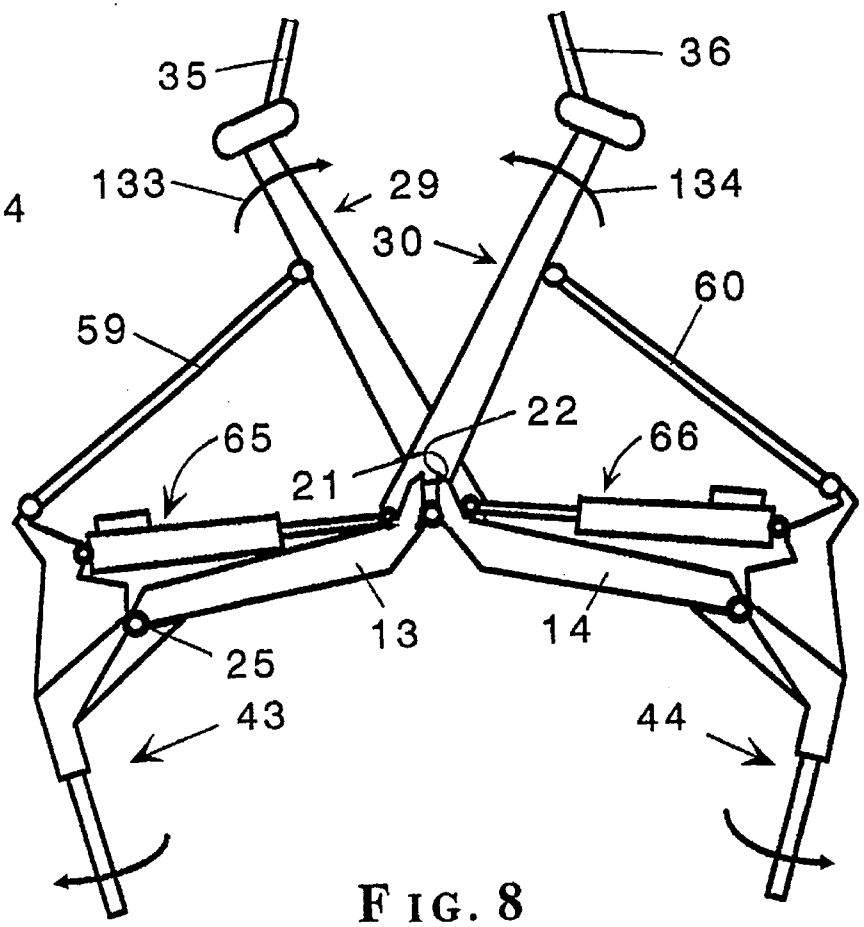
FIG. 8 is a simplified diagrammatic rear elevation of a grapple after the load has been dumped and the fingers are being reset.
Figure 7:
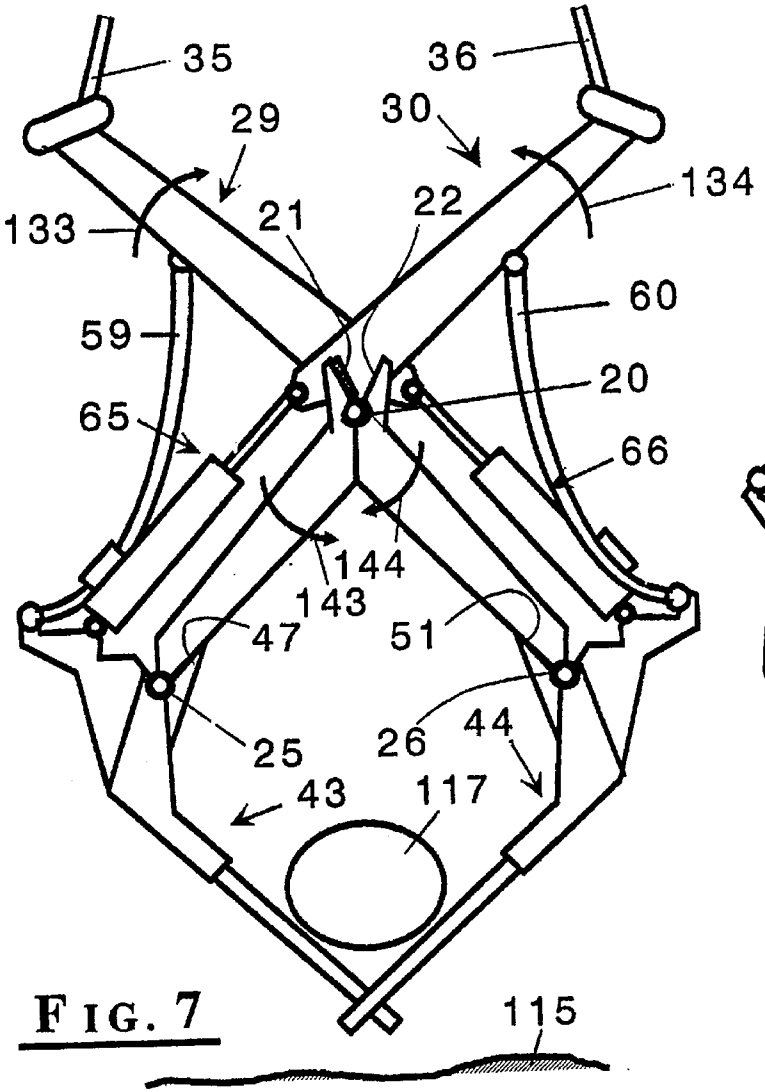
FIG. 7 is a simplified diagrammatic rear elevation of the grapple supported above the ground and carrying the load.

The grapple further comprises left and right fingers 43 and 44 which have intermediate portions 41 and 42 respectively which are hinged by the respective finger hinges. 25 and 26 to the outer portions 23 and 24 respectively of the frame members. The fingers 43 and 44 are shown in an open position thereof and have lower portions 45 and 46 respectively which are adapted to swing inwardly with respect to the frame members to grasp the load as will be described. The left finger 43 is thus hinged for rotation with respect to the frame member 13 about the hinge 25, and rotation thereof is limited by first and second stops 47 and 48 which are adapted to contact the outer portion 23 of the frame member so as to limit swinging of the finger with respect to the frame. Thus, the first stop 47 contacts a lower surface of the member 13 to limit inwards swinging of the lower portion 45 of the finger relative to the frame member 13 (as shown in FIGS. 6–8). Similarly, the second stop 48 contacts an upper surface of the member 13 to limit outward swinging of the lower portion 45 of the finger 43 (as shown in FIG. 1). Similarly, the right finger has first and second stops 51 and 52 which similarly limit inwards and outwards swinging of the lower portion 46 with respect to the frame member 14. It can be seen that the stops 47, 48, 51 and 52 cooperate with the fingers and the respective frame members to limit angular relationship between each finger and the respective frame member.

The fingers 43 and 44 have upper portions 55 and 56 respectively which also provide the stops 48 and 52 respectively. The grapple has left and right cable portions 59 and 60 which are connected to the upper portions 55 and 56 of the left and right fingers 43 and 44 and extend to intermediate portions of the left and right arms 29 and 30 respectively. Sufficient tension in the cable portions 59 and 60 forces the second stops 48 and 52 against respective frames 13 and 14 which in turn forces the outwards stops 21 and 22 of the frames against each other, i.e. all the relevant stops are activated. Interference between the stops and tension in the cable portions 59 and 60 prevents the arms from moving closer together than angle 58 as shown, the angle being typically about 20 degrees.

Lengths of the cable portions 59 and 60 are fairly critical, because if the cable portions are too long the stops 21 and 22 will not contact each other and the fingers will not open sufficiently to grasp a full load. However, the angle 58 will stabilize at about 15 to 20 degrees, depending on weight of the grapple supported by the cable portions. If the cable portions 59 and 60 are too short, the stops 48, 52, 21 and 22 are activated and the angle 58 will be greater than about 20 degrees which is a disadvantage as preferably the arms 29 and 30 should be as upright as possible to provide maximum swinging range of the arms to actuate the grapple as will be described. Clearly, when set correctly, the cable portions 59 and 60 serve as arm stops to limit upwards movement of the arms when the grapple is supported by the cable 37. The cables can incorporate an optional coil spring or resilient, shock-absorbing portion 62 to absorb shock and to provide additional advantages as will be described.

In summary, the cable portions 59 and 60 serve as flexible tension links, each of which extends between the upper portion of a particular finger to the adjacent arm located on the same side of the grapple hinge as the particular finger. When the cable portions 59 and 60 are fitted with a spring or shock-absorbing portion 62, they are termed resilient flexible tension links. Thus, it can be seen that each finger has an intermediate portion adjacent the respective finger hinge, a lower portion extending below the finger hinge and being adapted to contact the load, and an upper portion extending above the finger hinge and being connected to an adjacent arm with a flexible tension link.

As best seen in FIG. 3, the grapple 10 has two lower portions 45 of the left finger, and two lower portions 46 of the right finger. The portions 45 are disposed outwardly of the portions 46 and spaced laterally apart therefrom so as to permit the lower portions of the fingers to overlap as will be described. This facilitates gathering bundles of logging debris and also assists in enabling the grapple to stand upright when supported on generally level ground by the lower portions of the fingers. Thus, it can be seen that lateral space between the intermediate portions 42 of the left fingers provides the grapple with an overall width 63 which can be between 2 and 4 feet (0.6–1.2 meters) which is a considerable lateral width when compared with conventional logging grapple having only a single pair of fingers.

The grapple further comprises a latching mechanism 64 which includes left and right hydraulic latches 65 and 66 which resemble hydraulic cylinders, each of which has an independent, closed hydraulic circuit as will be described with reference to FIG. 4.

As best seen in FIG. 2, the right latch 66 has a hollow cylindrical body 68 which has a cylinder body hinge 70 secured to a latch portion 69 which projects inwardly from the upper portion 56 of the right finger 44. Spacing 71 between axes of the cylinder body hinge 70 and the finger hinge 25 is a critical spacing to provide a moment arm for the force from the latch acting on the finger, and vice versa, as will be described. The latch 66 also has a piston rod 72 having an outer end fitted with a piston rod hinge 74. The piston rod hinge 74 is connected to a horn 76, which is adjacent the inner portion 31 of the left arm 29 and is similarly spaced at a critical spacing 78 from the main hinge 20 to provide a moment arm.

An optional resilient link 81 is shown in broken outline extending between the left arm 29 and the left frame member 13, a portion of which member is also shown in broken outline for simplicity. The optional link 81 (and an equivalent link for the frame member 14 and the arm 30) can be a light cable with a relatively light coil spring which lightly resiliently interconnects the arm on one side of the main hinge to the frame member on the same side. As will be described, when the grapple is supported vertically as shown, and the arm is unsupported, weight of the arm causes the arm to swing downwardly and in these instances the optional resilient link 81 is not required. However, if the grapple tilts or falls over so that weight of the arm does not assist in lowering the arm, resiliency in the resilient link 81 moves the arm towards its respective frame member which is necessary to reset the latches for subsequent actuation of the grapple as will be described.

Referring again to FIG. 1, the latch 65 is essentially identical to the latch 66 and is disposed on an opposite side of the longitudinal plane 48 and thus is a mirror image thereof. Thus, it can be seen that the left and right latches 65 and 66 extend between the left and right fingers 43 and 44 respectively (located on left and right sides of the main hinge 20) and right and left arms 30 and 29 respectively (located on the right and left sides respectively of the main hinge).

FIG. 4

In the latch 66, the piston rod 72 is connected to a piston 87, the piston rod and piston being longitudinally reciprocable within and relative to the hollow cylindrical body 68 as is well known. The piston divides the cylinder into a head chamber 85 adjacent a head end of the cylinder, and a rod chamber 86 containing the rod 72. A cylinder conduit 89 extends between a cylinder port 91 of the body communicating with the rod chamber 86 and adjacent the piston rod hinge 74, and a cylinder valve, i.e. a solenoid valve 93. The solenoid valve has a valve body 95 which has a valve conduit 97 which cooperates with a cylinder port 99 of the body 68 communicating with the head chamber 85 adjacent the body hinge 70. The valve 93 has an axially slidable valve member 101 which is spring-urged against a valve seat to close the conduits 89 and 97 as shown, and is retractable in response to an electrical signal which is generated when the helicopter operator, usually the pilot, manually actuates an electrical load dump switch, not shown. The valve is therefore a normally closed, 2-position solenoid valve in which the conduits 89 and 97 are closed when the valve is unenergized as shown which is the normal operating position. When the solenoid is energized, the valve member shifts so that the valve opens to permit communication between the ports 91 and 99. The conduit 97 has a flow restriction which limits flow rate through the conduits 89 and 90 to a particular value as will be described. Thus, the cylinder conduits 89 and 97 extend between opposite ends of the cylindrical body 68, and the associated cylinder valve, namely the solenoid valve which is located in the cylinder conduit to control flow in the said conduit.

The piston 87 has a piston conduit 103 extending between opposite faces 105 and 106 of the piston. A spring-actuated piston check valve 108 is located in the piston conduit to permit flow of fluid from the face 108 to the opposite face 106, that is in a flow direction per an arrow 110 which occurs when the piston rod is extending from the cylinder. Clearly the valve 108 is spring closed to prevent flow of fluid in the opposite direction, i.e. when the rod is retracting and the valve 93 is closed. The valve 108 thus determines flow through the valve in direction of the arrow 110, and prevents flow in the opposite direction. There is a relationship of flow resistance between the piston conduit 103 and the cylinder conduit 89 as follows. When the cylinder valve 93 is open, that is the solenoid valve 93 is energized, maximum fluid flow through the cylinder valve is at a rate less than maximum flow through the piston valve 108 as the rod extends. In the usual closed position of the cylinder valve 93, flow through the cylinder conduit 89 is prevented and maximum rate of extension of the piston rod is determined by flow rate through the piston check valve 108. When the valve 93 is open, maximum rate of rod retraction is dependent on flow rate through the conduits 89 and 99 because the piston conduit 103 is closed by the valve 108.

As described previously, when a prior art grapple releases its load, the grapple fingers usually open quickly and a shock is transferred through the supporting cable to the helicopter which could be dangerous. In order to reduce the shock that would otherwise occur when releasing a load, the fingers of the present grapple are designed to open slowly, even though opening forces can be relatively high as they are generated by weight of the load acting on the grapple fingers. As will be described with reference to FIG. 8, the grapple is opened by releasing or un-locking the extended latch and permitting it to retract slowly which reduces shock load. In contrast, as will be described with reference to FIG. 5, after releasing the load, the latch is re-set by extending under weight of the arms 29 and 30, and thus re-setting should occur relatively quickly to reduce turnaround time for operation. To attain these two conflicting requirements, flow through the solenoid or cylinder valve 93, which occurs during dumping of the load when the cylinder retracts, is selected to be relatively slow, whereas flow through the piston valve 108, which occurs during re-setting of the latch when the cylinder extends, is selected to be relatively fast. Thus, the latch is designed to be latched closed or locked when extended so as to maintain a particular closed Condition of the grapple until released by the solenoid valve. Thus, the valves 93 and 108 cooperate with the hydraulic cylinder to permit actuation of the cylinder in one direction with a relatively small resistance to produce a relatively fast response, and actuation of the cylinder in the opposite direction with a relatively large resistance to produce a relatively slow response.

Operation

The grapple condition shown in FIG. 1 represents condition of the unloaded grapple immediately prior to the grapple contacting the ground, i.e. a "ferrying" condition. The solenoid is normally de-energized, causing the solenoid valve 93 to be closed, and thus fluid movement with respect to the latch, i.e. reciprocation of the piston rod, is controlled by the piston valve 108. Weight of the grapple is supported by a single bifurcated cable 57, and complete operation of the grapple is controlled by the electrical cable extending from the electrical dump switch in the helicopter, to the solenoid valve 93 on the grapple. Alternatively, the solenoid valve can be fitted with a radio receiver and actuated by a radio signal, thus eliminating the electrical cable. Alternatively, other actuators can be substituted for solenoid, and other remote or wireless means of actuating the actuators can be devised.

FIG. 5

When the grapple 10 in the ferrying or open position thereof contacts ground 115, the lower portions 4S and 46 of the fingers 43 and 44 straddle a load 117, such as a log as shown. In many situations the load can be a bundle of pieces of wood, such as small logs, branches, etc., which are piled together to have a width less than overall spacing between the lower portions of the fingers. Preferably, for symmetry, the load could be gripped approximately mid-way along its length (see the width 65 of FIG. 3), and is arranged so that most of the fingers on each side can embrace the load.

When the grapple is supported on the ground, the second stops 48 and 52 of the fingers contact the respective frame members. Load in the cable portions 35 and 36 is reduced so that the cable portions slacken, and weight of the arms 29 and 30 causes the arms to rotate about the main hinge in direction of arrows 119 and 120 respectively to lowered positions as shown. As the arm 29 rotates, the piston rod hinge 74 of the right latch 66 similarly rotates about the main hinge 20 in direction of the arrow 119, and subjects the latch 66 to tension. This draws the piston rod outwardly from the cylinder body while fluid simultaneously passes through the piston valve 105 into the chamber see FIG. 4. Flow through the piston valve 103 is relatively unrestricted, which permits relatively easy extension of the latch to a "re-set" extended condition, because force applied to the cylinder is generated by weight of the arms, which, in a raised position do not generate much force on the piston rod, at least initially, and thus the piston must extend relatively easily. Clearly, as the arm 29 approaches its lowered position, the force available for extension of the rod increases and this enables the piston rod to extend more rapidly to a maximum extended position where it is locked. Relatively unrestricted flow through the valve 103 reduces any delays for re-setting the latch prior to lifting the load. The arms 29 and 30 are inclined at approximately 20 degrees below the horizontal when in the fully lowered position which provides a sufficiently large angle of rotation for the arm to close the grapple, and then to open the grapple, as will be described with reference to FIGS. 6 through 8. The total rotation of the arms from the fully raised position as shown in FIG. 1 to the fully lowered position as shown in FIG. 5 is approximately 100 degrees, although this will vary with specific design requirements.

Thus, the latch is automatically extended and re-set by weight of the arms when the grapple is relieved of its weight, e.g. when the weight of the grapple is supported by the ground, and the arms are unloaded and the cable portions slackened, without any manual intervention by a person on the ground, or specific operation by the pilot. Clearly, for grasping a load from the ground, it is necessary that the grapple settles in the ground and this settling re-sets the grapple, facilitating operation of the invention.

Figure 5:
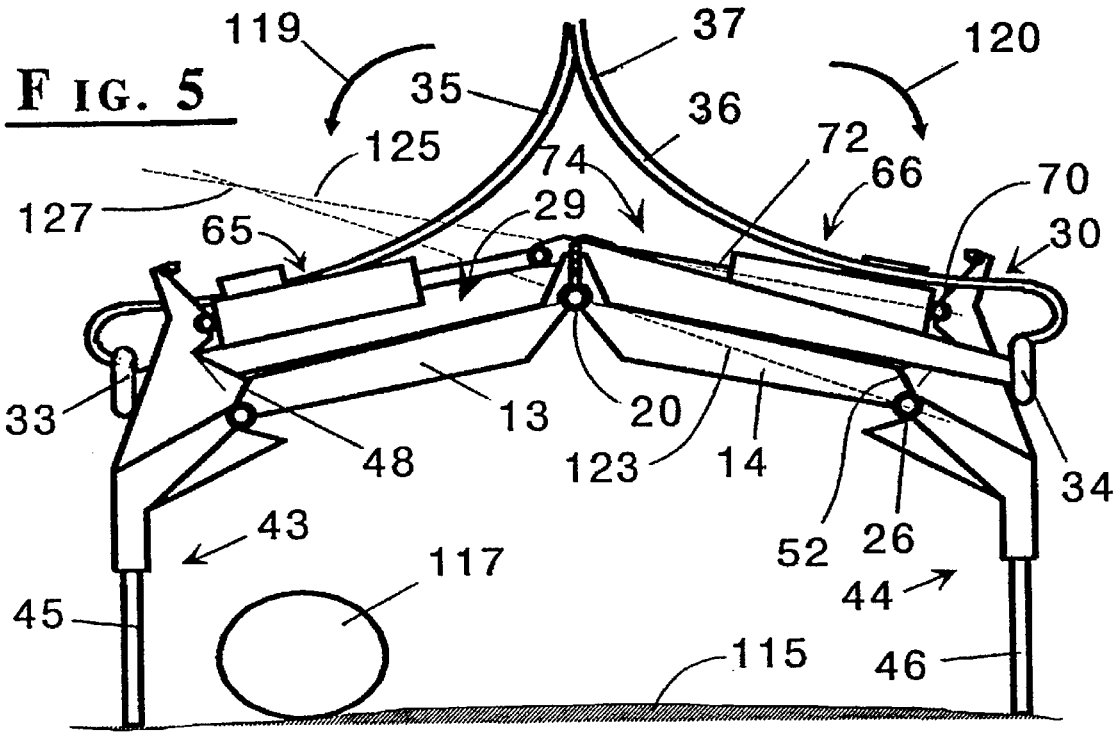
FIG. 5 is a simplified, diagrammatic rear elevation of the grapple shown empty and supported on fingers thereof contacting the ground, arms of the grapple being lowered, and a load being disposed between fingers.

Should the grapple be supported non-vertically, i.e. if it tilts excessively or topples from the vertical position as shown in FIG. 5, the weight of the arms may not be sufficient to lower the arms as shown in FIG. 5. In this non-vertical condition, tension in the optional resilient link 81 (if fitted) draws the arm 29 to the lowered position as shown, and a similar link, not shown, would cause the arm 3O to similarly be lowered. This lowering of the arms permits automatic re-setting of the grapple even if it shifts from the generally vertical position at rest as shown.

One important aspect of the geometry of the links is illustrated when the arms are lowered as shown in FIG. 5. A straight line 123 passing through the right finger hinge 26 and the main hinge 20 intersects a longitudinal axis of the piston rod/cylinder body of the right latch 66 at an intersection 127. It can be seen that the intersection is on a side of the main hinge remote from the latch and this is necessary for correct sequence of closing of the grapple as will be described with reference to FIG. 6.

FIG. 6

As the helicopter rises, the bifurcated cable 37 and the cable portions 35 and 36 become taut, causing the arms and 30 to rise initially by rotating about the main hinge 20 in direction of arrows 133 and 134 respectively. The initial rotation of the arm 30 is essentially immediately transferred to the left latch 65, which is immediately subjected to compression. As the solenoid valve is closed, and the piston valve prevents retraction of the piston rod, the latch is essentially a non-compressible rigid link which applies a corresponding force to a latch portion of the finger 43, causing the finger to rotate in direction of an arrow 139 about the finger hinge 25.

At this stage further raising of the bifurcated cable 37 tends to relieve the fingers 43 and 44 from carrying much of the weight of the grapple, permitting the fingers to scrape the ground while rotating inwards slightly towards the load as shown. Thus, the second stops 48 and 52 are de-activated as the arms rotate, and after the fingers have rotated through about 30 degrees, the first stops 47 and 51 contact adjacent lower surfaces of the frame member and prevent further rotation of the fingers. Further raising of the bifurcated cable 37 now applies a turning moment to the frame members 13 and 14 which rotate concurrently about the main hinge 20 and inwardly towards each other per arrows 143 and 144 respectively. This rotation of the frame members about the axis 20 causes the outwards stops 21 and 22 of the frame members (see FIG. 1) to separate from each other, and permits the lower portions 45 and 46 of the fingers to move more closely towards each other as the arms 29 and 30 continue to rotate upwardly in direction of the arrows 133 and 134. The cable portions 35 and 36 are inclined to each other at an angle 131 and clearly, the greater the angle 131, the greater the turning moment produced on the arms 29 and 30.

FIG. 7

As the helicopter continues to rise, the arms 29 and 30 continue to rotate upwardly, and the frame members 13 and 14 continue to rotate inwardly towards each other about the main hinge axis 20 per the arrows 143 and 144 until the inwards stops 27 and 28 of the frame members 13 and 14 contact each other as shown, or are stopped by contacting the load. Before this stage, the lower portions of the fingers contact the load and move it upwardly as the fingers are forced under the load. Eventually, as the helicopter rises, the grapple is completely raised above the ground and thus combined weight of the grapple and the load is borne by the cable portions 35 and 36. If the load is bulky, the fingers contact the load and thus are prevented from moving further inwardly to a fully closed position as shown, thus preventing activation of the stops.

However, for smaller loads, the fingers are not restricted against inwards movement by the load and attain a fully closed position as shown. In this fully closed position, the relevant stops are activated, i.e. the first stops of the fingers contact the frame members, and the inwards stops of the frame members contact each other. When further inwards rotation if the frame members and further inwards movement of the lower portions of the fingers are prevented by the stops, preferably, extreme lower ends of the fingers cross each other as shown to ensure that small portions of the load cannot fall between the fingers. Preferably, the cable portions 59 and 40 have a length such that, when the load is sufficiently small that the rotation of the fingers and frame is prevented by the relevant stops instead of by size of the load, the cable portions 59 and 60 are slightly slack as shown.

The sequence of relative rotation occurring during grasping of the load is important, and results from the geometry of the grapple, in particular the convergence of the centre line 125 with the straight line 123 as shown in FIG. 5, and the relative angular movement between the fingers and the frame members, and between the frame members themselves as determined by the stops. Clearly, to enable the fingers to pass under the load when completing the grasping of the load, the fingers shift from an initial vertical position as shown in FIG. 5, to a steeply inclined position as shown in FIG. 6 wherein the fingers are inclined at about 70 degrees to the horizontal, and to a more shallowly inclined position as shown in FIG. 7, wherein the fingers are inclined at approximately 40 degrees to the horizontal.

The load is now securely supported by the grapple, and it can be seen that the fingers are held in the crossed position by opposing forces generated by the first stops 47 and 51 of the fingers which contact the frame members, the inwards stops 27 and 28 of the frame members which contact each other, the latches 65 and 66 which are locked and under compression.

FIG. 8

The opposing forces described above are proportional to weight of the load and the grapple, and clearly, when the grapple and the load are carried, the latches are under compressive forces. The load is carried by the helicopter to the dump site, and at a suitable altitude the pilot activates the electrical dump switch, not shown, which activates and opens the solenoid valve 93 (FIG. 4) to permit fluid to flow along the cylinder and valve conduits 89 and 97 to contact the latches. The solenoid valves stay open as long as the dump switch is activated and the latches retract under the compressive loads generated by weight of the load in the fingers, and the other forces of the grapple itself. If the fingers are not fully closed when the load is grasped because the load is relatively large, the stops are not activated and the cable portions 59 and 60 will be slacker than in the position shown in FIG. 7. Releasing the load from this condition initially causes the cable portions 59 and 60 to become taut suddenly, and the resilient or shock-absorbing portion 62 (if used) in each cable absorbs any shock to reduce shock being transferred to the fingers and arms, so as to reduce any resulting initial shock loads on the helicopter. On the other hand, if the load grasped by the grapple is relatively small, which enables the fingers to overlap each other and the relevant stops to be activated, when the load is released, the cable portions 59 and 60 are slightly slack as previously indicated, and this reduces the chances of shock loads.

Initially, tension in the cable portions 59 and 60 and force of the load resting on the fingers outwardly tend to rotate the fingers towards the open position. Location of the attachment of the cable portions 59 and 60 to the arms 29 and 30 is important and generally the cable is attached about half-way between the main hinge 20 and the outer portions 33 and 34. This ensures that, for a given rotation of the arms 29 and 30 during opening, there is a corresponding larger rotation of the fingers.

In order to reduce shock loads further on the helicopter during opening of the grapple, the flow through the solenoid valve 93 is restricted as previously described, causing relatively slow retraction of the latches and slow initial movement of the fingers. Initially, the load is released by rotation of the fingers 43 and 44 about the respective finger hinges 25 and 26 relative to the frame members 13 and 14. Thus, the first stops 47 and 51 separate from the frame members as the fingers swing downwardly releasing most of the load. Simultaneously, the arms 29 and 30 rotate upwardly, which, due to the cable portions 59 and 60 becoming taut, assist in generating forces to cause outwards rotation of the fingers about their respective finger hinges. Thus, the left and right cable portions 59 and 60 are taut during dumping and assist in retracting the latches.

As the latches retract further, the frame members 13 and 14 start to rotate away from each other, so that the inwards stops 27 and 28 become disengaged from each other. During further opening of the grapple, the first stops of the fingers can move away from the frame members again, and relative rotation between the fingers and the frame members, and the frame members themselves is dependent on many factors. In any event, it is important that initial rate of retraction of the latch is relatively slow, and is controlled by the deliberate restriction in the cylinder conduits and solenoid valve so as to reduce any shock load that might be transferred to the helicopter during the opening of the grapple. As the cylinders continue to retract, the frame members continue to rotate outwardly about the main hinge and the arms continue to rise, drawing the cable portions 59 and 60, and the fingers 43 and 44 correspondingly upwardly. Thus, the fingers are opened further by interconnecting adjacent fingers and arms, and drawing the fingers upwardly concurrently as the arms move upwardly.

When the outwards stops 21 and 22 contact each other, further rotation of the frame members is prevented, but continued retraction of the cylinders causes the fingers to rotate about respective finger hinges so that the first stops 47 and 51 become or remain disengaged from the frame members. As the arms continue swinging upwardly, the cable portions 59 and 60 continue to draw upper portions 55 and 56 of the fingers upwardly, concurrently contracting the latches. The latches continue to retract until they pass through respective minimum contracted lengths, Which is equivalent to top dead centre positions of reciprocating pistons, after which the latches extend again. Eventually, the second stops 48 and 52 of the fingers contact the respective frame members so that further outwards rotation of the fingers is prevented and the grapple assumes the position as shown generally in FIG. 1. It should be added that if the cable portions 59 and 60 are too long, after dropping the load the stops 21 and 22 may not contact each other before the arms stop rotating and the fingers will not be fully open. On the other hand, if the cable portions 59 and 60 are too short, the first stops 47 and 51 on the fingers, and/or the inwards stops 27 and 28 of the frames may not be in contact, and the minimum finger opening will be unnecessarily large, and perhaps will not be able to hold relatively small loads. The lengths of the cable portions 59 and 60 are critical and weight and geometry of the apparatus will determine optimum length of the cable portions, based on simple experimentation.

It is added that, as the grapple apparatus changes between the configurations of FIG. 8 and FIG. 1, the hydraulic latch may pass through a position in which the piston is fully retracted. In FIG. 1 the piston is almost fully retracted, and in FIG. 7 it is almost fully retracted and between these two positions the piston passes through the fully retracted position. When the piston passes through or is adjacent the fully retracted position, little extension or retraction of the piston is generated by rotation of the arms 29 and 30, so that friction associated with movement of the piston, termed latch friction, is low. Even when the solenoid valve is locked, the arms can move lower through several degrees, typically about 5 degrees on either side of the fully retracted position, but can not move any further until the solenoid valve has been actuated to allow full movement retraction of the piston.

Thus, when the piston is adjacent the fully retracted position, there is sufficient flexibility, low latch friction and clearance to enable the arms to drop slightly initially even when the solenoid valve is closed. Permitting the latches to pass through the minimum lengths thereof, that is past equivalent top dead centre, results in a shorter stroke for the piston, so that there is less friction to overcome than in a longer stroke piston. The above movement about top dead centre also increases force on the latch which increases the rate of actuation. Preferably, extension of the piston rod from the cylinder is limited by a conventional stop, not shown, so that maximum extension of the rod is as shown in FIG. 5, in which the grapple is in the fully open position with the arms in the lowest position and the grapple supported on a horizontal surface. If extension of the cylinders is not limited, problems could otherwise arise if the grapple is supported with one side higher than the other so that the arms could attain different positions which would result in the grapple being raised unevenly.

The location of the cable portion 59 on the arm 29 also effects the operation of re-opening the grapple and the time taken to re-open the grapple. If the load is light, or the pilot had to abort a pick-up for some reason and the fingers are closed with no load, load on the arms is relatively light and correspondingly compression force on the latches is relatively low when compared with a normal load, so that retraction of the latches occurs slowly. Re-opening of the grapple is initiated as soon as the fingers start to open, i.e. the latches commence to retract. Opening the grapple is normally completed while the pilot is flying back from the dump site to the pick-up site, and a typical complete re-opening time of 5 seconds is acceptable. However, if the pilot has to abort a pick-up and the grapple re-opening occurs while hovering over the load to be picked up, a 5 second delay or longer can be significant, and this unacceptably long delay is best reduced by an optional latch mechanism control as will be described. In general, other factors being constant, the closer the arm connections of the cable portions 59 and 60 to the main hinge 20, the larger the forces available to shorten the time to re-set the latches, but correspondingly the greater the rotation of the arms is required to re-open the grapple.

Geometry of this, grapple is critical as the arms rotate upwardly through a relatively wide angle, while the fingers and frames rotate inwardly and then outwardly through relatively small angles, thus providing a mechanical advantage for gripping. It has been shown above that re-setting of the latch occurs when the arms move from their fully raised position of FIG. 1 to the fully lowered position of FIG. 5. In contrast, while the arms swing from a fully lowered position in FIG. 5 to a fully raised position in FIG. 1, the fingers move from a fully open position to a fully closed position (FIG. 7) and back to a fully open position again. This movement is best understood by analyzing incremental movements of the arm 29 and the finger 43 as below.

From the configuration shown in FIG. 5 to the configuration shown in FIG. 6, the arm 29 rotates approximately 25 degrees upwardly, and the finger 43 rotates inwardly approximately 20 degrees, from a position in which the second stop 48 contacts the frame member 23 to a position in which the first stop 47 contacts the frame member 13. From the configurations of FIG. 6 to FIG. 7, the arm 29 rotates further approximately 30 degrees, and the frame 13 rotates approximately 30 degrees so as to swing from the outwards stops 21 and 22 in contact to the inwards stops 27 and 28 in contact. It is noted that the angle of rotation of the arms is greater than the angle of rotation of fingers since the intersection 127 (FIG. 5) is on the arm side of the main pivot to ensure the fingers rotate before the frame rotates. Likewise, rotation of the frame and finger is the same as rotation of the arm since the finger, the frame and arm rotate as a unit. From the FIG. 7 configuration, through the configurations of FIG. 8 to FIG. 1, i.e. to release and fully re-open the grapple, the arms 29 and 30 rotate a further 45 degrees upwardly which causes the frames to rotate upwardly, and the stops 27, 28, 47 and 52 are disengaged and the stops 21, 22, 48 and 52 are engaged. To effect the above, the total arm rotation is about 100 degrees.

If the angle 58 between the arms 29 and 30 is less than about 15 degrees, weight of the grapple does not develop sufficient force to keep the fingers 43 and 44 wide open. The angle 58 should be at least 20 degrees, so when fully closed the arms must be 20 degrees below the horizontal to provide sufficient rotation to open and close the fingers and frame members.

In summary, it can be seen that the latches 65 and 66 are selectively lockable, extensible and retractable depending upon loads applied to the latches, and operating condition of the cylinder valve. In addition, rate of actuation of the latch is variable depending on the stage of operation. For example, when the arms are being lowered immediately after lowering the grapple to be supported on the ground with the fingers extending generally downwardly and the grapple open, the latches are relatively quickly extended and automatically locked because the solenoid valve is closed. When the arms are being raised, the latches are still extended and locked, and as the grapple rises slightly, the fingers are being rotated and located generally adjacent each other to grasp the load therebetween. When the grapple is fully suspended and carrying the load, the arms are raised and the latches are still extended and locked. To release the load, the latches are unlocked and slowly start to retract because weight of the load forces the fingers apart and the latches to retract, thus resulting in release of the load.

The method according to the invention is for lifting a load with the grapple and then releasing it, and is best summarized by dividing the method into several distinct steps as follows. Initially, the grapple is supported above the load lying on the ground so that the pair of arms of the grapple extend generally upwardly, and a pair of fingers extend generally downwardly in an open position thereof. The method is broadly characterised by relieving the arms from weight of the grapple so that weight of the arms lowers the arms while the pair of fingers remain in the open position. This is followed by re-setting a latching mechanism associated with the arms and fingers as the arms are lowered. The weight of the grapple can be relieved from the arms by supporting the grapple on the ground, so that fingers contact the ground on opposite sides of the load to support the grapple. To grip the load, the method is further characterised by raising the arms so that the re-set latching mechanism is subjected to force from the grapple, causing the fingers to move inwardly to grasp the load. The grapple is transported to a drop zone and positioned in a desired altitude, and the latching mechanism is released so that force from the grapple causes relative movement between the arms and the fingers causing the fingers to at least partially open. The fingers are opened further by the interconnection between adjacent fingers and arms with the cable portions 59 and 60 which draw the fingers upwardly concurrently as the arms move upwardly. Preferably, after releasing the latching mechanism, the opening of the fingers is deliberately retarded to reduce shock loads that would otherwise by generated during opening of the grapple. It can be seen in this embodiment that permitting the arms to rotate downwardly about the main hinge axis causes the pair of latches to be extended so as to re-set the latch mechanism to permit the grapple to be closed. In an alternative embodiment to be described with reference to FIGS. 12 and 13, the latching mechanism is retracted when the arms are lowered for re-setting which, while the re-setting occurs in an opposite direction to the above described embodiment, the re-setting is required to perform the same function.

It is noted that the latches are designed to fail-safe, so that if the electrical cable controlling actuation of the mechanisms became fouled with other portions of the grapple and is broken, the valve would not open unintentionally causing the load to release. The load can only be released by application of an electrical signal to the solenoid valves, which is the only action required on the part of the pilot after positioning the grapple in the dump zones.

In addition, it can be seen that the latching mechanism is re-set automatically, without requiring any intervention by the pilot, or a ground based operator, and thus the apparatus can be operated without manual support on the ground in the actual area of loading and unloading. Because no ground operators are required, safety is increased, as well as reducing labour costs.

Alternatives

It can be seen that relative angular movement between the frame members themselves, the arms themselves, and the fingers with respect to the respective frame members is limited by certain stops, which are shown to be simple shoulders adapted to contact adjacent surfaces when the rotation is to be limited. The stops assume an important role during operation of the apparatus, for example while supporting the grapple above the ground prior to picking up the load, outwards movement of the fingers is prevented by locating each finger against a respective first stop. When the arms are raised for lifting the load, the fingers move inwardly to grasp the load until the fingers contact the second stops, thus facilitating grasping the load more or less symmetrically and preventing over-closing of the fingers which could present problems when releasing the load. The stops control limits of angular relationship between the various members, can be very finely adjusted for particular purposes and clearly substitutes can be devised. For example, the cable portions 59 and 60 extending between the arms and respective fingers also serve essentially as stops to limit angular separation between the arm and its respective finger. While most of the stops are shown closely related to the hinge, clearly they can be located remotely from the hinge. Preferable, all stops are fitted with resilient pads so as to reduce shock loads when moving the members contact the respective stop.

The hydraulic latch 66 is shown having an externally mounted conduit valve, namely the solenoid valve 93, and an internally mounted piston check valve 108. Clearly, the check valve 108 permits fluid to flow from the rod chamber 86 adjacent the rod hinge 74 to the head chamber 85 adjacent the body hinge 70. As an alternative, if desired, the valve 108 can be located in a conduit externally of the cylinder to provide similar flow control to permit easy servicing, and also to provide means to adjust flow rate through the check valve if required. To enable greater control of relative speeds of actuation of the latch mechanism, an optional solenoid valve can be added in parallel with the first solenoid valve 93 to connect a third port, not shown, generally adjacent the port 91, to a fourth port, not shown, generally adjacent the port 99. This provides a second connection which can bypass the restriction deliberately incorporated in the solenoid valve 93. The second solenoid valve can be activated when the arm reaches a pre-set position, for example when the cable portion 60 becomes taut, or when the fluid pressure drops to a pre-set value so that the fingers can be re-opened quickly by allowing the fluid to flow quickly after the load is dumped, and when the danger of inducing a heavy shock loading is essentially eliminated. This is of advantage to increase the speed of re-opening the fingers and arms as previously described, particularly is a pick-up has been aborted. Alternatively, the second solenoid can be actuated by a switch mounted between the arms 29 and 30 not shown, to switch current from the first solenoid to the second solenoid when the arms approach each other in a particular location. Alternatively, the valve 93 can have two open positions of different resistance and these can be selected manually.

In the embodiment of FIGS. 1 through 8, each latch is located generally above a respective frame member and extends between the upper portion of one respective finger and the respective arm. Locating the latches above the frame members tends to protect the latches from possible inadvertent contact with the load, thus reducing chances of damage. However, the latches are relatively heavy and tend to result in the grapple having a relatively high centre of gravity, contributing to instability when the grapple is supported on the ground. Also, the cable 37 is bifurcated and has the cable portions 35 and 36 which are directly connected to the arms 29 and 30 respectively. For very heavy loads, angle of application of force by the cable portions 35 and 36 to the arms is not optimum, reducing available clamping force between the fingers for a given load. The above aspects are addressed in an alternative embodiment to be described with reference to FIG. 9.

FIG. 9

A second embodiment of the invention 150 has left and right frame members 153 and 154, left and right arms 157 and 158, and left and right fingers 161 and 162 respectively, all cooperating in a manner generally similar to that previously described. Thus, inner portions of the frame members are hinged at a main hinge 164 and the fingers 161 and 162 are hinged to the frame members at finger hinges 165 and 166. The embodiment 150 further includes a latching mechanism 168 which comprises left and right hydraulic latches 169 and 170 respectively, each latch extending between a finger and a respective arm to partially control angular relationship between the finger and the respective arm for actuation of the grapple as previously described. Thus, the right latch 170 extends between a latch portion 173 of the finger 162 and a horn 175 of the left arm 157 and clearly functions equivalently to the right latch of the first embodiment. Similarly, the left latch 169 extends between a horn 176 of the right arm 158, and a corresponding latch portion 177, shown in broken outline, of the left finger 161. Similarly to the first embodiment, the second embodiment has first and second stops which cooperate with the fingers and the respective frame members to limit angular relationship between each finger and the respective frame member. Thus, first and second stops 179 and 180 are shown secured to the frame member 153 and cooperating with a stop portion 182 of the finger 161 to limit inwards and outwards rotation respectively of the finger relative to the frame member 153. Similar first and second stops, not shown, cooperate with the right finger 162 to limit angular movement thereof with respect to the frame member 154. Clearly, the first and second stops 179 and 180 are fixed with respect to the frame members, and the stop portion 182 is a portion of the finger 161 and moves between the stops. These stops and related portions function equivalently to the first embodiment in which the first and second stops 47 and 48 move with the left finger 43 and cooperate with the adjacent outer portion 23 of the left frame member 13. It can be seen that the latches 169 and 170 are positioned lower relative to the frame members 153 and 154 than the latches of the first embodiment thus lowering the centre of gravity to enhance stability of the grapple. In addition, the latches lie alongside the frame members and thus produce a more compact grapple than that shown in the first embodiment. This may have particular advantages in certain application. In both embodiments, each latch extends generally parallel to a respective frame member.

Upper portions of the arms 157 and 158 carry left and right pulleys 185 and 186 respectively. Left and right cable portions 189 and 190 extend from a main cable 192, pass around the pulleys 185 and 186 respectively, and have respective ends 193 and 194 connected to the opposite arms 158 and 157 respectively. It can be seen that by passing the cable portions around the pulleys 185 and 186, mechanical advantage of force applied to the arms is improved over that found in the first embodiment, thus enhancing gripping forces of the finger portions on the load, other factors being constant. Clearly, such pulleys could be incorporated in the embodiment of FIGS. 1–8.

In another alternative, to enhance gripping forces on the load, and to enable faster re-setting of the arms, optional spring and cable combinations can extend between the arms and frame members on each side, namely between the arm 157 and the frame member 153, and the arm 158 and the frame 154, and is generally equivalent to the resilient link 81 of FIG. 2. The greater the strength of the spring, the greater force is available to grab the load and increase speed of re-setting the fingers by reducing the effects of friction in the latch mechanism.

Figure 10:
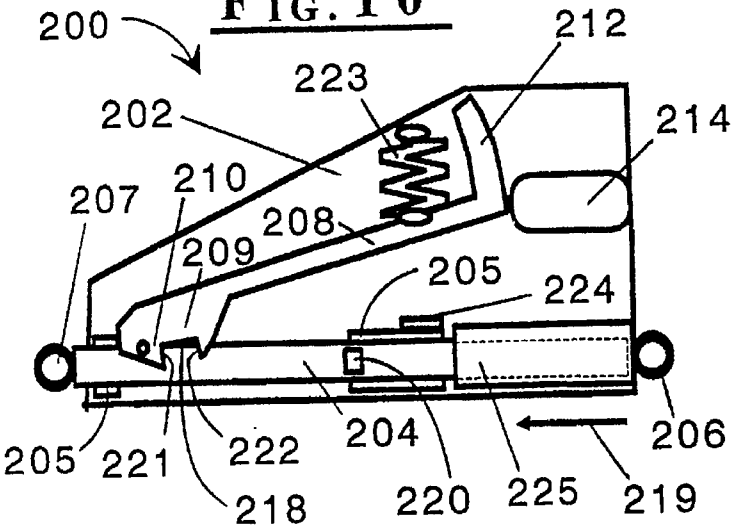
FIG. 10 is a simplified fragmented diagram of an alternative mechanical latch according to the invention which can be substituted for the hydraulic latch shown in FIG. 4, the mechanical latch being shown retracted.
Figure 11:
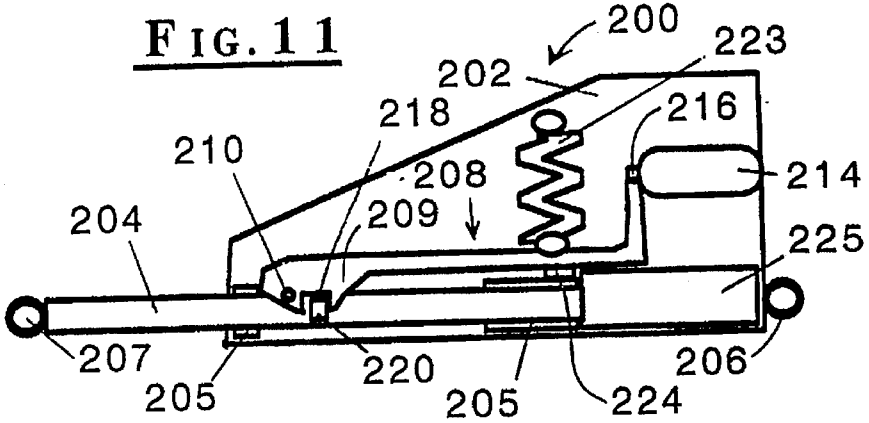
FIG. 11 is a diagram similar to FIG. 10 but with the mechanical latch shown extended.

FIGS. 10 and 11

Figure 9:
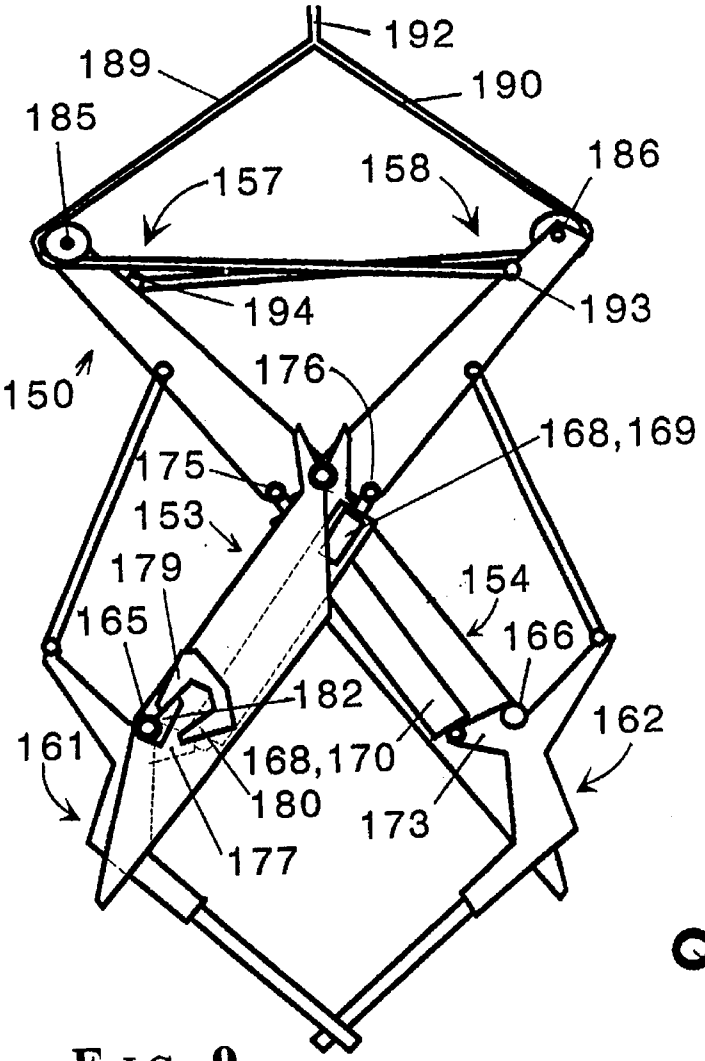
FIG. 9 is a simplified diagrammatic rear elevation of a second embodiment of the invention showing alternative locations of twin hydraulic latches.

The latches 65 and 66 of FIGS. 1 through 8 and 169 and 170 of FIG. 9 are hydraulic mechanisms which function in a manner somewhat similar to a linear ratchet mechanism but with a control mechanism, namely passive and active valves which control flow direction and flow rate to enable control of the grapple, as well as accurate control of speed of response of the mechanism. An alternative mechanical latch will be described, and may be appropriate in some circumstances.

An alternative mechanical latch 200 has a plate-like body 202 and a rod 204 mounted for axial and reciprocable movement relative to the body in a manner somewhat similar to a piston rod. The body 202 is located adjacent a frame member of the grapple, and the rod is mounted for axial sliding by a pair of aligned rod guides 205 secured to the body. The body has a body hinge 206, and the rod has a rod hinge 207 located at an end of the rod remote from the body hinge 206. The hinges 206 and 207 are disposed on an axis of reciprocation of the rod 204, not shown, and are equivalent to the body hinge 70 and the piston rod hinge 74 respectively of the hydraulic latch 65 of FIG. 1 through 4. Thus, the hinges of the mechanical latch 200 cooperate with the arm and respective finger of the grapple in a manner similar to that shown in the two previous embodiments.

The latch further includes a latching arm 208 having an inner end 209 hinged at a ratchet hinge 210 to the body for rotation between a retracted position shown in FIG. 10 and an extended position shown in FIG. 11. The arm 208 has an outer end 212 having an arcuate portion which is designed to sweep past a solenoid 214 as the arm moves between the extended and retracted positions thereof. The solenoid has a spring-loaded plunger 216 which normally extends outwardly as shown in FIG. 11 when the solenoid is de-energized, but retracts when actuated, or it can be resiliently depressed as shown when the arm 208 is in the retracted position.

The inner end 209 further includes a rectangular indent 218 which has a pair of spaced apart oppositely facing shoulders 221 and 222 which can receive therebetween a rod stop 220 carried on the rod 204. When the latching arm 208 is retracted, the stop 220 can pass beneath a projection from the shoulder 222, but cannot pass beneath the shoulder 221 and thus the shoulder 221 limits outwards extension of the rod. When the latching arm is extended as shown in FIG. 11, the stop 220 is received in the indent and the shoulders 221 and 221 limit movement of the rod 204 in either direction. An arm stop 224 is positioned adjacent the rod guides 205 to limit further extension of the latching arm 208, so that when the latching arm 208 is in a maximum extension position the arm contacts the stop 224. In this position, the spring loaded plunger 216 of the solenoid extends outwardly as shown to limit upwards movement of the arm 208, and the stop 224 limits downward movement of the arm.

A dashpot 225 is located generally adjacent the body hinge 206 to cooperate with an inner end of the rod 204 so as to retard or slow down inwards movement of the rod 204 as it retracts from the extended position shown in FIG. 11 to the retracted position shown in FIG. 10, that is in opposite direction to the arrow 219. The dashpot has a negligible effect on extension of the rod in direction of the arrow 219. Thus, the rod can extend in the direction of the arrow 219 relatively quickly, but is retarded or slowed against retraction by the dashpot. Preferably, speed of the dashpot is adjustable to attain a suitably slow retraction response when opening the grapple. Thus, the mechanical latch 200 has two different speeds of response depending on the direction of actuation, that is whether the rod 204 is undergoing extension or retraction, and clearly the latch 200 is functionally similar to the hydraulic latch 66 of FIG. 4. As described previously, after releasing the latching mechanism, the opening of the fingers is initially deliberately retarded or slowed down by the dashpot to reduce shock loads that would otherwise be generated during opening of the grapple as previously described.

The hinge 210 is located with respect to the indent 218 so that the stop 22O generates a force on the latching arm 208 depending on the direction of movement of the rod 204. Thus, when the rod 204 is urged outwardly so as to extend the rod in direction of an arrow 219, the stop 220 acts on the shoulder 221 and tends to draw the latching arm 208 downwardly to the extended position. Conversely, when the rod 204 is urged inwardly in a direction opposite to the arrow 219, the stop 220 can act on the shoulder 222 to push the arm 208 outwardly to the retracted position as shown in FIG. 10. The latch further includes a relatively light tension coil spring 223 which extends between the body 202 and the arms 208 to draw the arm lightly upwardly to the retracted position as shown in FIG. 10.

In operation, the latch functions equivalently to the hydraulic latches as follows. As the arms 29 and 30 are lowered with respect to the grapple (as shown in FIG. 5), the rod 204 is drawn outwardly from the retracted position as shown in FIG. 10, to the extended position as shown in FIG. 11 with negligible resistance from the dashpot 225. As the stop 220 enters the indent 218, it contacts the shoulder 221 of the indent 218 and pulls the latch arm into the extended position as shown in FIG. 11, overcoming light tension in the spring 223 and preventing any further outwards movement of the rod 204. Extending the latch arm draws the outer end 212 of the latch arm across the plunger 216 of the solenoid which is initially retracted. However, as the outer end 212 sweeps past the plunger 216, the plunger 216 becomes free to resiliently extend from the solenoid as the arm 208 contacts the stop 224, so that the plunger 216 and the stop 224 hold the latch arm in the extended position as shown in FIG. 11. Thus, with the solenoid de-energized, the plunger 216 automatically holds the latch 200 in the extended position against force from the spring 223, and the shoulders 221 and 222 located on opposite sides of the stop prevent essentially any relative movement the rod 204 and the body 202. Thus, when the rod 204 is extended and locked by the latch arm, the latch 200 serves as an incompressible link and is equivalent to the locked hydraulic cylinder of the hydraulic latches previously described and is in this condition when the grapple is carrying a load.

When the grapple is carrying the load, the mechanical latch 200 is subjected to a compressive force similarly to the hydraulic latches. The latching arm 208 is held extended by the spring-loaded plunger 216, and the stop 220 is urged against the shoulder 222 of the indent 218. When the load is to be released from the grapple, the solenoid 214 is energized, the plunger 216 retracts, and force from the stop 220 acting on the shoulder 222 forces the latching arm to the retracted position as shown in FIG. 10, permitting the arm 204 to retract inwardly with respect to the body. Forces acting on the arm 208 to move it from the extended to retracted position are generated mostly by the stop 220 acting on the shoulder of the recess, and is only assisted by the spring 223. Speed of retraction of the rod 204 with respect to the body is determined by the dashpot 225 which slows opening of the grapple to release the load with minimal shock being imparted to the helicopter. To further reduce any shock loads, shock absorbing resilient mountings are preferably fitted at one or both of the hinges 206 and/or 207.

Thus, it can be seen that the latching arm is mounted for movement relative to the body between retracted and extended positions thereof, and the latching arm cooperates with the stop on the rod to lock the rod in the extended position. In addition, it can be seen that the solenoid serves as an actuator which cooperates with the latching arm to locate the latching arm in the extended position so as to lock the rod in the extended position, in one condition, and in an opposite condition to permit the latching arm to retract so as to permit the rod to retract.

The mechanical latch 200 is preferred in some instances as it is considered that it has less friction than the hydraulic latch as previously described. However, because it has less friction, speed of response is faster than the hydraulic latch, and thus the dashpot 225 is provided to reduce Shock loads to the helicopter incurred during opening. Similarly to the hydraulic latch, it is held in the extended position representing a loaded grapple, without power from the solenoid, and thus is essentially fail safe. Only when an electrical signal retracts the plunger 216 can the rod retract relative to the body, permitting opening of the grapple to drop the load.

The mechanical latch 200 as disclosed is locked in the extended position by the actuator and thus functions in a manner generally parallel to that of the hydraulic latches as previously described, which are also locked in the extended position. However, by re-positioning the mechanical latch and other components, the latch could be made to operate in a reversed arrangement, in which it is locked in the retracted position, while permitting the grapple to function as previously described. In this alternative mechanical latch, the actuator locks the latching arm in one position thereof, which locks the rod in one position thereof, and in an opposite condition of the actuator, the latching arm can assume another position to permit the rod to assume another position. While this alternative is not illustrated, the latch can be designed to permit equivalent operation of the grapple. In addition, while previous latching mechanisms are shown to have two latches, in an alternative, a single mechanical latch could be used to function in an opposite direction, e.g., as disclosed in FIGS. 12 and 13 for a generally equivalent hydraulic latch.

Figure 13:
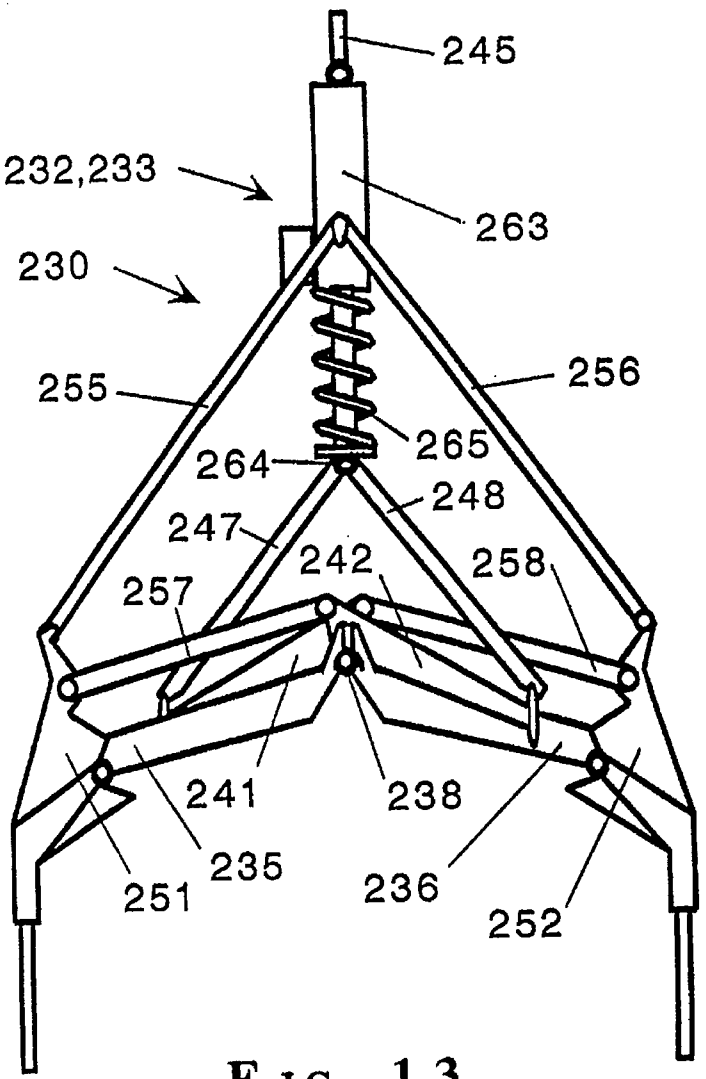
FIG. 13 is a simplified diagram similar to FIG. 12 showing the third embodiment with the single hydraulic latch shown extended.
Figure 12:
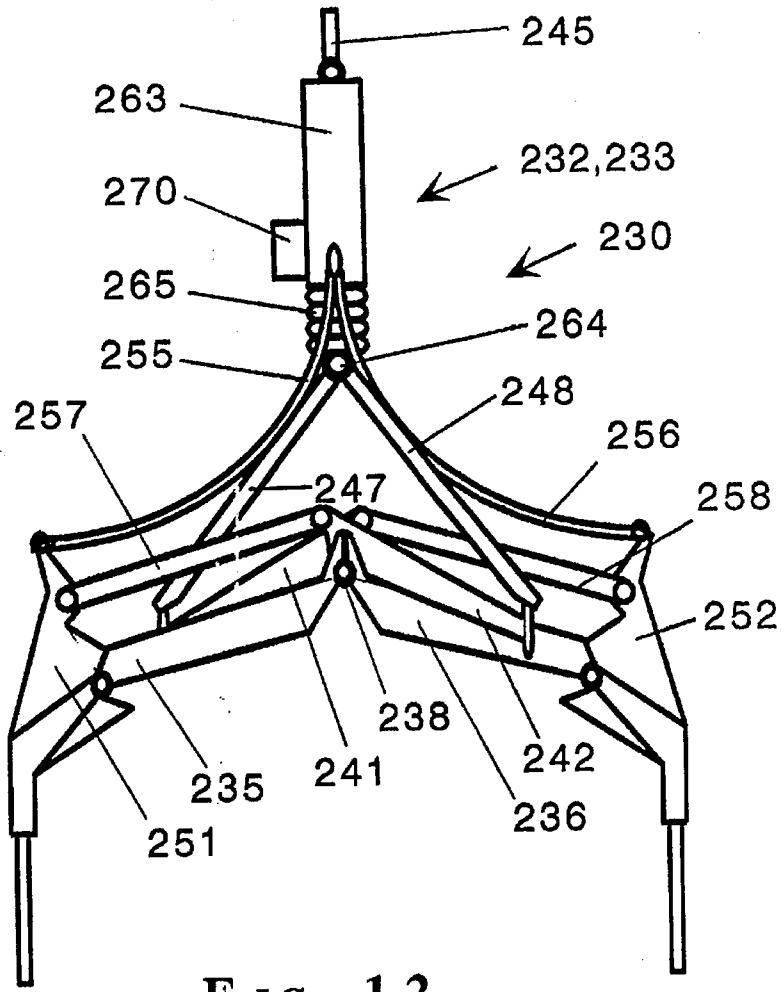
FIG. 12 is a simplified diagrammatic rear elevation of a third embodiment of the invention showing an alternative location of a single hydraulic latch, the latch being shown retracted.

FIGS. 12 and 13

A third embodiment 230 of the invention bears many similarities to the first embodiment, but a major different between the two embodiments relates to substitution of a single alternative latch 232 for the two latches 65 and 66 of FIGS. 1 through 7. The single latch 232 thus serves as a latching mechanism 233 and controls operation of the embodiment 230, and is equivalent to the latching mechanism 64 of the first embodiment. However, the latches 65 and 66 of the first embodiment have been eliminated and a pair of rigid struts 257 and 258 substituted as follows.

The third embodiment comprises left and right frame members 235 and 236 hinged at a main hinge 238, and left and right arms 241 and 242 having inner portions hinged together at the main hinge 238, and outer portions cooperating with left and right arm cable portions 247 and 248. A support cable 245 is connected to an upper end of the latch 232 to support the latch, and the cable portions 247 and 248 extend from the latch 232 to outer portions of the arms 241 and 242 respectively. The grapple apparatus further comprises left and right fingers 251 and 252 hinged to the respective frame members 235 and 236 respectively. The frame members, the arms and the fingers are provided with undesignated complementary stops, and all can be essentially identical to those previously described with reference to FIGS. 1–3. Left and right finger cable portions 255 and 256 extend from the latch mechanism to upper portions of the arms and have a critical length relative to the arm cable portions 247 and 248 as will be described.

The left and right struts 257 and 258 extend between a finger on one side of the hinge and an arm on the opposite side of the hinge as follows. The strut 257 extends between an upper portion of the left finger and an inner portion of the right arm 242, and the right strut 258 extends between an upper portion of the right finger 252 and an inner portion of the left arm 241. It can be seen that the struts, which are essentially incompressible rigid links, are direct substitutes for the latches 65 and 66, when locked as previously described with reference to FIGS. 1–8 of the first embodiment. Thus, each rigid link extends between an upper portion of the finger on one side of the main hinge and an inner portion of the respective arm on the opposite side of the main hinge.

The latch 232 has a first latch portion 263 connected to a lower end of the support cable 245 and to the finger cable portions 255 and 256 so as to cooperate with the fingers, and a second latch portion 264 connected to the arm cable portions 247 and 248 so as to cooperate with the arms. It can be seen that a flexible tension link, that is the cable portion 255 (256) extends between the first latch portion 263 and a respective finger 251 (252) and a flexible tension link, i.e. the cable portion 247 (248) extends between the second latch portion 264 and the respective arm 241 (242). The second portion acts as a piston rod and is selectively telescopically extendable and retractable with respect to the first portion along a vertical axis between a retracted position as shown in FIG. 12, and an extended position as shown in FIG. 13. A tension coil spring 265 encloses the second portion, and applies an inwardly directed force to the piston rod so as to tend to retract the second portion when unloaded. The spring 265 is relatively light and is insufficient to overcome weight of the arms as will be described.

Figure 4:
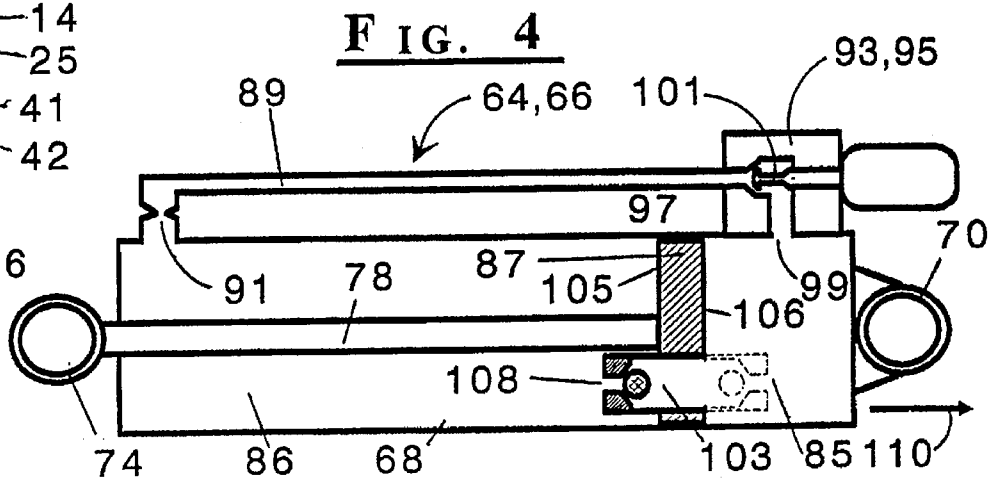
FIG. 4 is a simplified, fragmented longitudinal section through a hydraulic latch according to the invention.

The latch 232 has many similarities structurally to the hydraulic latch 66 of FIG. 4, but functions in a reverse direction from the latch 66. The latch 232 has a cylinder body and piston, not shown, generally similar to the body 68 and piston 87 of FIG. 4. The piston of the latch 232 has a piston check valve controlling internal flow across the piston between head and rod chambers on opposite sides of the piston. An external solenoid valve 270, mounted on the cylinder body, controls an external valve conduit which communicates the said chambers externally of the body. In contrast to the latch 66, in the latch 233 the valve 270 communicates with the rod chamber so that pressure in the rod chamber is controlled by the solenoid valve 270. During retraction of the latch 232, the fluid flows across the piston from the head chamber to the rod chamber, but the piston check valve prevents flow during extension, except externally through the valve 270. In this way, the piston can be locked in a retracted position as shown in FIG. 12, and extended in a controlled manner by applying a tensile load thereto after actuating the solenoid valve to attain the extended position as shown in FIG. 13. Clearly, the tensile load is applied to the latch 232 by the cable portions, and is generated by weight of the arms 241 and 242 acting on the cable portions 247 and 248 respectively.

It is noted that the forces in the single latch embodiment are lower than in the two latch embodiment, but stroke of the single latch is considerably longer, for example 4 to 6 times longer than stroke in the two latch embodiment. For example, the stroke of the latches of the two latch embodiments of FIGS. 1 through 11 is about 6 inches (15 centimetres), whereas the stroke of the single latch embodiment of FIGS. 12 and 13 would be about 2 to 3 feet (60 to 90 centimetres). Thus, spacing between the upper ends of the finger cable portions and the upper ends of the arm cable portions can be about 3 to 4 feet (90 to 120 centimetres) which can present some operational difficulties. It is considered that operation of the third embodiment of FIGS. 12 and 13 is generally not as elegant or as practical as the operation of the two latch embodiment.

As indicated previously, relative lengths of the arm cable portions and finger cable portions is critical. Length of the arm cable portions 247 and 248 is such that, when a small load is carried so that the fingers of the grapple can close against the stops, as shown in FIG. 7, the finger cable portions 255 and 256 are slightly loose or just becoming taut. However, when the latch 233 is released so that the fingers of the grapple are fully open, the finger cable portions 255 and 256 become taut and open the fingers 251 and 252, and the frame members 235 and 236 swing open as shown in FIG. 13. When the third embodiment is set upon the ground, in a position similar to FIG. 5, the four cable portions 247, 248, 255 and 256 become slack so that the tension coil spring 265 can retract the latch to attain the position shown in FIG. 12.

What is claimed is:

1. A grapple apparatus comprising:

(a) left and right frame members having inner portions hinged together at a main hinge, (b) left and right arms having inner portions hinged together at the main hinge and outer portions cooperating with a supporting cable, (c) left and right fingers adapted to grasp a load, each finger being hinged by a respective finger hinge to a respective frame member and being connected to an arm, and (d) a latching mechanism cooperating with the fingers and the arms to partially control angular relationship between each finger and a respective arm for actuation of the grapple, the latching mechanism being selectively responsive to weight of the grapple.

2. A grapple apparatus as claimed in claim 1, in which:

(a) the latching mechanism is selectively extensible and retractable.

3. A grapple apparatus as claimed in claim 2, in which the latching mechanism includes a hydraulic latch which comprises:

(a) a hydraulic cylinder having a hollow cylindrical body and a piston and piston rod, the piston and rod being longitudinally reciprocable relative to the cylindrical body, and (b) fluid valves cooperating with the hydraulic cylinder to permit actuation of the cylinder in one direction with a relatively small resistance, actuation of the cylinder in an opposite direction with a relatively large resistance, and also locking of the cylinder to prevent relative movement between the piston and the body.

4. A grapple apparatus as claimed in claim 3, in which the hydraulic latch further comprises:

(a) a piston conduit extending between opposite faces of the piston and an associated piston check valve located in the piston conduit to permit flow of fluid from one side of the piston to the other side of the piston in one direction, and to prevent flow of fluid in the opposite direction, and (b) a cylinder conduit extending between opposite ends of the cylinder body and an associated cylinder valve located in the cylinder conduit to control flow in the said conduit so that, in an open position of the cylinder valve, the flow through the cylinder valve is at a rate less than flow through the piston valve, and in the closed position of the cylinder valve, flow through the cylinder conduit is prevented and the piston can move only in a direction as determined by the piston check valve.

5. A grapple apparatus as claimed in claim 1, in which the latching mechanism comprises:

(a) left and right latches, each latch extending between a finger and a respective arm.

6. A grapple apparatus as claimed in claim 5, in which:

(a) the left and right latches extend between the left and right fingers respectively located on left and right sides of the main hinge, and the right and left arms respectively located on right and left sides of the main hinge.

7. A grapple apparatus as claimed in claim 5, in which:

(a) each latch extends generally parallel to a respective frame member and between an upper portion of one respective finger and the respective arm.

8. A grapple apparatus as claimed in claim 7, in which:

(a) the latches are selectively extensible and retractable along a longitudinal axis, and (b) when the arms are lowered, the respective fingers extend generally downwardly and the grapple is open, and the latches are extended and can be locked when extended.

9. A grapple apparatus as claimed in claim 8, in which:

(a) when the arms are raised and the latches are extended and locked, the fingers are located generally adjacent each other to grasp load therebetween, and (b) when the arms are raised and the latches are unlocked, weight of the load forces the fingers apart to retract the latches and to release the load.

10. A grapple apparatus as claimed in claim 1, in which:

(a) each finger has an intermediate portion adjacent the respective finger hinge, a lower portion extending below the finger hinge and being adapted to contact the load, and an upper portion extending above the finger hinge being connected to an adjacent arm.

11. A grapple apparatus as claimed in claim 10, in which:

(a) the upper portion of a particular finger is connected to an adjacent arm located on the same side of the main hinge as the particular finger.

12. A grapple apparatus as claimed in claim 11, in which:

(a) a flexible tension link extends between the upper portion of a particular finger to the adjacent arm located on the side of the grapple hinge as the particular finger.

13. A grapple apparatus as claimed in claim 12, in which:

(a) the flexible tension link is also resilient.

14. A grapple apparatus as claimed in claim 1, further comprising:

(a) stops cooperating with the fingers and the respective frame members to limit angular relationship between each finger and the respective frame member.

15. A grapple apparatus as claimed in claim 14, in which:

(a) the stops include first stops, each of which limits inwards swinging movement of a lower portion of a respective finger relative to the respective frame member.

16. A grapple apparatus as claimed in claim 14, in which:

(a) the stops include second stops, each of which limits outwards swinging movement of a lower portion of a respective finger relative to the respective frame member.

17. A grapple apparatus as claimed in claim 1, in which the latching mechanism is a mechanical latch which comprises:

(a) a body and a rod mounted for relative reciprocable movement between extended and retracted positions thereof, the rod having a rod stop, (b) a latching arm mounted for movement relative to the body between retracted and extended positions thereof, the latching arm cooperating with the rod stop to lock the rod in one position thereof, (c) an actuator cooperating with the latching arm so that, in one condition of the actuator, the actuator locks the latching arm in said one position thereof so as to lock the rod in the said one position thereof, and in an opposite condition of the actuator, the latching arm can assume another position to permit the rod to assume another position, and (d) a dashpot cooperating with the rod so that speed of movement of the rod relative to the body in one direction is slowed by the dashpot compared with speed of movement in the opposite direction.

18. A grapple apparatus as claimed in claim 1, in which the latching mechanism comprises:

(a) a single latch having a first latch portion connected to a lower end of the support cable and cooperating with the fingers, and a second latch portion cooperating with the arms, so that selective movement between the first and second latch portions can change the angular relationship between the arms and the fingers to actuate the grapple.

19. A grapple apparatus as claimed in 18, in which:

(a) the latch is selectively extensible and retractable along a longitudinal latch axis, so that the second latch portion can extend longitudinally with respect to the first latch portion, (b) a flexible tension link extends between the first latch portion and a respective finger, and (c) a flexible tension link extends between the second latch portion and a respective arm.

20. A grapple apparatus as claimed in claim 19, in which:

(a) left and right rigid links extend between the left and right fingers respectively located on left and right sides of the main hinge, and the right and left arms respectively located on the right and left sides of the main hinge.

21. A grapple apparatus as claimed in claim 20, in which:

(a) each finger has an intermediate portion adjacent the respective finger hinge, a lower portion extending below the finger hinge and being adapted to contact the load, and an upper portion extending above the finger hinge being connected to an adjacent arm, and (b) each rigid link extends between an upper portion of the finger on one side of the main hinge and an inner portion of the respective arm on the opposite side of the main hinge.

22. A method of lifting and releasing a load with a grapple, the method comprising the steps of:

(a) supporting the grapple above a load lying on the ground so that a pair of arms of the grapple extend generally upwardly, and a pair of fingers of the grapple extend generally downwardly in an open position thereof, relieving the arms of the grapple from weight of the grapple, so that weight of the arms lowers the arms while the pair of fingers remain in said open position, (c) re-setting a latching mechanism associated with the arms and fingers as the arms are lowered, (d) raising the arms so that the re-set latching mechanism is subjected to force from the grapple, causing the fingers to move inwardly to grasp the load, and (e) releasing the latching mechanism so that force from the grapple causes relative movement between the arms and the fingers causing the fingers to at least partially open to release the load.

23. A method as claimed in claim 22, further characterised by:

(a) relieving the arms from the weight of the grapple by supporting the grapple on the ground.

24. A method as claimed in claim 22, further characterised by:

(a) permitting the arms to rotate downwardly about a main hinge which hinges the arms so as to cause said lowering of the arms under weight of the arms, and (b) extending a pair of latches of the latching mechanism when the arms are lowered, each latch connecting a finger on one side of the main hinge with an arm on the opposite side of the hinge axis.

25. A method as claimed in claim 24, further characterised by:

(a) when releasing the latching mechanism, permitting each latch of the latching mechanism to retract under weight of the grapple to cause said relative movement between the arms and the respective fingers, thus causing the fingers to at least partially open.

26. A method as claimed in claim 22, further characterised by:

(a) permitting the arms to rotate downwardly about a main hinge which hinges the arms so as to cause said lowering of the arms under weight of the arms, and (b) retracting at least one latch of the latching mechanism when the arms are lowered, the latch cooperating with the fingers and arms.

27. A method as claimed in claim 26, further characterised by:

(a) when releasing the latching mechanism, permitting a latch of the latching mechanism to extend under weight of the grapple causing said relative movement between the arms and the fingers, thus causing the fingers to at least partially open.

28. A method as claimed in claim 22, further characterised by:

(a) while supporting the grapple above the ground as recited in said step (a) of claim 22, locating the fingers against a first stop to extend downwardly, and (b) when raising the arms as recited in said step (d) of claim 22, moving the fingers inwardly to grasp the load or until the fingers contact a second stop.

29. A method as claimed in claim 22, further characterized by:

(a) after releasing the latching mechanism as recited in said step (e) of claim 22, and permitting the fingers to at least partially open under weight of the grapple, opening the fingers further by interconnecting adjacent fingers and arms and by drawing the fingers upwardly concurrently as the arms move upwardly.

30. A method as claimed in claim 22, further characterised by:

(a) after releasing the latching mechanism as recited in said step (e) of claim 22, deliberately retarding opening of the fingers to reduce shock loads that would otherwise be generated during opening of the grapple.

* * * * *